United States Patent [19]

Fletcher

[11] Patent Number: 4,587,810

[45] Date of Patent: May 13, 1986

[54] THERMOELECTRIC ICE MAKER WITH PLASTIC BAG MOLD

[75] Inventor: Charles J. Fletcher, Sparta, N.J.

[73] Assignee: Clawson Machine Company, Inc., Franklin, N.J.

[21] Appl. No.: 634,833

[22] Filed: Jul. 26, 1984

[51] Int. Cl.[4] ..... F25B 21/02; F25C 1/04

[52] U.S. Cl. ..... 62/3; 62/1; 62/340; 62/530; 249/61; 249/130; 383/38

[58] Field of Search ..... 62/1, 3, 530, 340; 249/61, 119, 126, 127, 129, 130; 383/38, 41, 42

[56] References Cited

U.S. PATENT DOCUMENTS

| | | | |
|---|---|---|---|
| 2,964,920 | 12/1960 | Staebler | 62/1 X |
| 3,040,539 | 6/1962 | Gaugler | 62/3 |
| 3,167,925 | 2/1965 | Elfving | 62/3 |
| 3,194,023 | 7/1965 | Sudmeier | 62/3 |
| 3,200,600 | 8/1965 | Elfving | 62/3 |
| 3,207,420 | 9/1965 | Navarrete-Kindelan | 383/38 |
| 3,480,015 | 11/1969 | Gonzalez | 62/3 X |
| 3,940,232 | 2/1976 | Stock | 62/530 X |
| 3,958,750 | 5/1976 | Prybeck | 383/38 |
| 4,055,053 | 10/1977 | Elfving et al. | 62/3 |
| 4,181,285 | 1/1980 | Vangedal-Nielsen | 249/61 |
| 4,223,043 | 9/1980 | Johnson | 62/1 X |
| 4,478,386 | 10/1984 | Mikkelsen | 249/119 X |

*Primary Examiner*—William E. Tapolcai

*Attorney, Agent, or Firm*—Pollock, Vande Sande & Priddy

[57] ABSTRACT

An ice maker with a flexible wall bag supported on a planar cooling surface and having a plurality of water compartments for molding ice cubes. The planar cooling surface is in direct thermal communication with a thermoelectric refrigeration unit for freezing water contained in the ice mold bag. The cooling surface may be the bottom of a cooling tray cooperating with an insulated housing to define a freezing chamber for receiving the ice mold bag. The refrigeration unit is mounted on the bottom wall of the cooling tray. The insulated housing includes an insulated door for access into the freezing chamber and may comprise integral front, rear and side walls. The insulated housing and cooling tray are detachably supported within a cabinet for housing the refrigeration unit. The flexible walls of the ice mold bag are of a material that is easily ruptured for removal of individual ice cubes and may include additional means to facilitate wall rupture.

27 Claims, 6 Drawing Figures

FIG 3
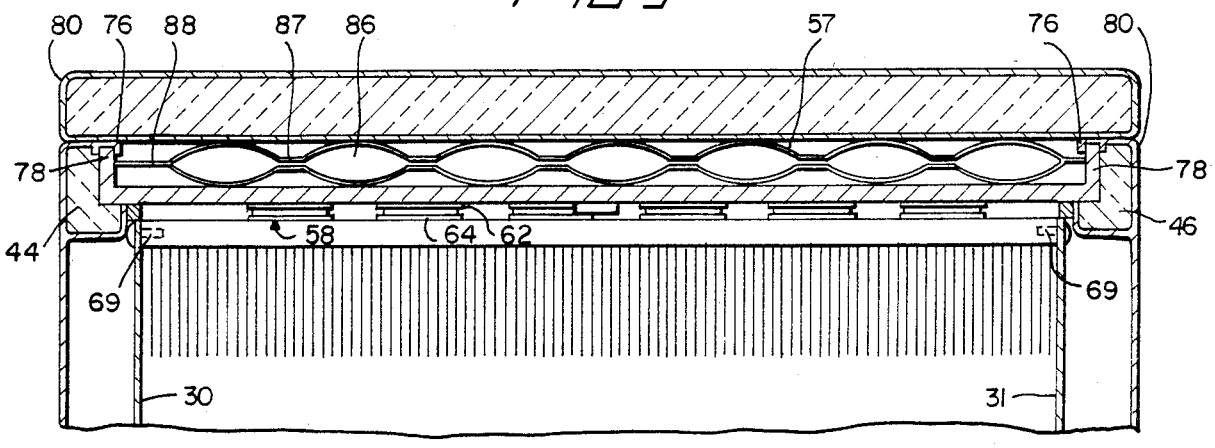
FIG 4
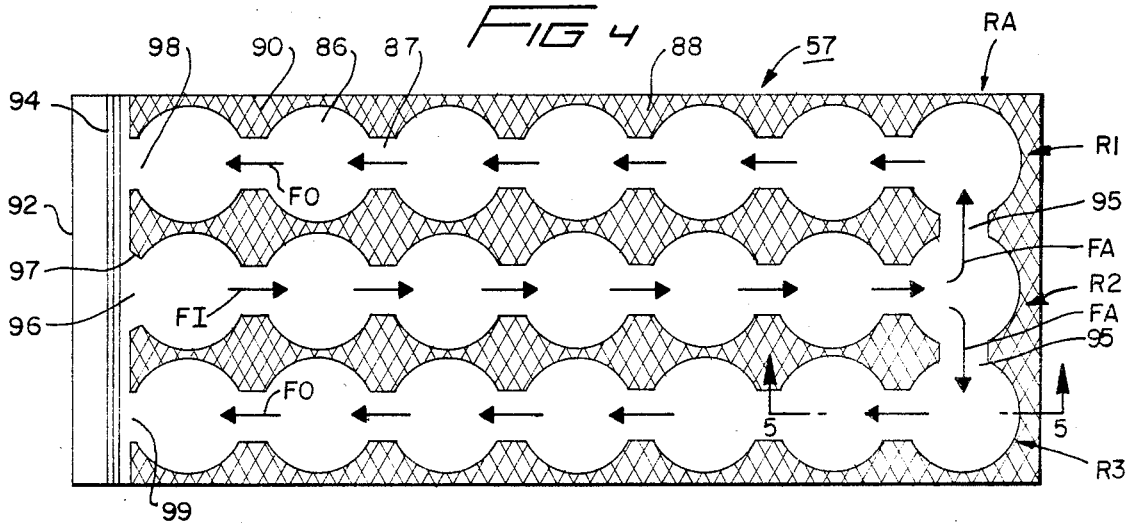
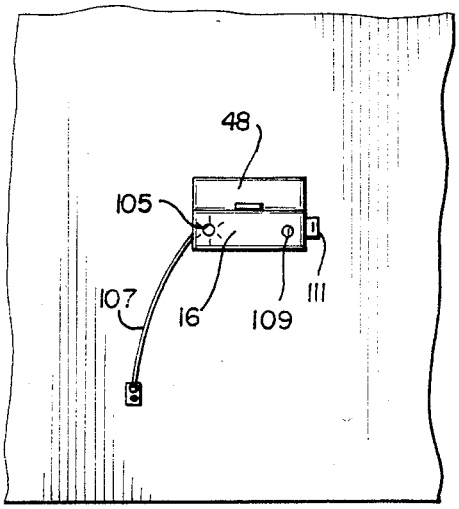
FIG 5
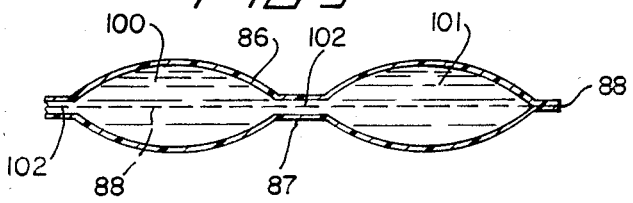
FIG 6

THERMOELECTRIC ICE MAKER WITH PLASTIC BAG MOLD

TECHNICAL FIELD

The field of this invention relates to thermoelectric ice makers and more particularly to an ice maker for rapidly making ice in a compartmented bag for molding ice cubes and preserving them in a sanitary condition.

BACKGROUND OF THE INVENTION

Thermoelectric units have been used previously for refrigeration and for freezing water to make ice. Prior thermoelectric ice makers are exempliefied by U.S. Pat. No. 3,192,726 to Newton and U.S. Pat. No. 4,055,053 to Elfing, et al., the entire contents of each of these patents being incorporated herein by reference. Many such thermoelectric units, as well as ice making units employing conventional refrigeration systems, make relatively large amounts of ice of which only a portion is used at any one time. The unused portion is then kept in an accessible storage bin as commonly found in hallways and refreshment areas of hotels, motels and the like. Since only a portion of the accumulated ice is dipped out of such storage bins by a succession of users, contamination of the remaining ice may occur through personal contact during removal of the desired portion. These central bins are often unsecured and easily opened and therefore there is also a risk of ice contamination by someone intentionally dumping trash or chemicals into the accumulated ice.

It has been suggested in the past, to employ a flexible wall bag in combination with a conventional refrigeration system having a separate compartmented mold of metal as exemplified by U.S. Pat. No. 2,964,920 to Staebler, the entire contents of this patent being incorporated herein by reference. The bag suggested by this reference has no internal compartments but instead relies upon the compartments of the separate mold structure to compress the flexible bag walls into the shape of the ice cubes desired. Unfortunately, compartmented molds of the type suggested by this reference have become increasingly expensive to manufacture and have not found wide utilization.

There is therefore a need for an ice maker of more sanitary and inexpensive construction for providing relatively small batches of ice cubes for use in motel and hotel rooms and in vehicles of all types. An ice maker for these applications also needs to be of a compact and durable construction having relatively small physical dimensions so as to facilitate mounting the unit on the wall of a hotel or motel room or in a vehicle.

Problems have also been experienced in the past with the use of thermoelectric assemblies for refrigeration in that cooling rates were low and condensation of moisture around thermocouples and the like has caused deterioration of the semiconductor materials employed and short circuiting of electrical terminals. The present invention includes features which also will overcome these disadvantages of the prior art.

DISCLOSURE OF THE INVENTION

A principle object of the present invention is to provide a compact ice maker having a flexible wall bag or mold for shaping and preserving the sanitary condition of a relatively small quantity of individual ice cubes. Another object of the invention is to provide a flexible wall bag or container within which sanitary ice cubes may be made and then remain sealed until actual use of the ice cubes is desired. A further object is to provide a thermoelectric ice maker capable of rapidly making and storing in isolation limited quantities of ice cubes in locations where space is at a premium and convenience is of prime importance.

The present invention is an improvement over that described in co-pending application Ser. No. 475,822, filed Mar. 16, 1983, now U.S. Pat. No. 4,487,024, the entire contents of this application being incorporated herein by reference. As discussed in this pending application, one advantage of sealed storage is that the water cannot be contaminated while it is being frozen and stored prior to being dispensed for use as ice. One advantage of the present invention over that prior invention is that the present invention eliminates the need for the moving parts, automatic controls and other components associated with current reversal for loosening ice from a rigid mold and ice harvesting cycles in addition to freezing cycles. The additional space required for sealed storage of ice cubes after their release from fixed ice mold is also eliminated.

The present invention employs a miniaturized refrigeration system which relies upon efficient thermoelectric modules in direct contact with a metal cooling or refrigerating tray for supporting a flexible wall bag having a plurality of individual compartments each of a size corresponding to the size of the ice cubes desired. The individual compartments of the bag are of a shape selected to yield ice cubes of the desired shape. The compartmented bag thus serves both as an ice cube mold for freezing water in the desired shapes and as a storage container for maintaining the sanitary condition of the ice cubes after they are made.

The thermoelectric modules are secured to the cooling tray and are sealed from the atmosphere to prevent condensation of moisture from ambient air and the penetration of such moisture into the interior thermocouples of the modules. The invention provides a compact ice cube maker of such reduced size as to permit its personalized use in offices, in hotel and motel rooms, and in the operator's compartment of boats, airplanes, trucks, cars, trailers, and other vehicles. After the ice cubes are made each is stored in its individual compartment within the plastic bag and the bag is kept sealed to ensure that the ice cubes remain sanitary until the bag is torn open so as to dispense the ice for use. Thus, there can be no physical contact with the ice cubes until they have been removed from the compartmented bag for use. So that the individual ice compartments can be easily opened, the bag is made of a relatively thin-film plastic material that is easily ruptured by hand. The bag also provides a convenient package for carrying the ice cubes from the ice maker to another location at which the ice is to be dispensed for use.

By the terms "thermoelectric module or unit" are meant any device employing the Peltier effect for cooling (or for heating, such devices being reversible in that heat can be selectively absorbed or released from the same side of a module by merely reversing the direction of current supplied to the module). In this specification, the "load side" refers to the side of the thermoelectric module attached to the cooling tray and the "sink side" refers to the side of the module attached to a heat exchange means for dissipating to a heat exchange fluid the heat pumped from the load side to the sink side in order to keep the cooling tray cold. The compartmented bag or container rests on the bottom of the cooling tray and heat is extracted from the bag to freeze liquid water contained in the water holding compartments of the bag. The cooling tray also forms the bottom wall and four sidewalls of an insulated freezing chamber and keeps this entire chamber sufficiently cold so that freezing of water in the bag compartments is aided by convection cooling.

In a preferred embodiment of the invention, the cooling tray sidewalls are embedded in insulating walls of a surround housing and the freezing chamber is bounded on its remaining side by an insulated top wall forming an access door into this hollow chamber of the housing. Although the walls of the cooling tray and of the surrounding housing may be curved or of some other shape, the ice maker housing is preferably a rectangular body bounded on five sides by insulated walls and on the sixth side by the bottom of the cooling tray. The thermoelectric modules are secured directly to the outer surface of the cooling tray bottom wall on the side opposite from the inner surface that supports the compartmented ice bag. The cooling tray extends horizontally and may be either parallel or slanted in relation to the horizontal direction. Preferably, both the cooling tray and the top wall of the insulated housing are slanted at about 15° to 60°, more preferably 30° to 45°, and most preferably about 30° to 35° relative to the horizontal so as to reduce the horizontal projection of the ice maker when it is mounted on a vertical wall, such as in a motel or hotel room. Another reason for the sloped or slanted positioning of the top surface of the ice maker housing is to prevent its use as a shelf on which miscellaneous articles might accumulate so as to interfere with operation of the door providing access into the freezing compartment.

The horizontally extending outer surface of the cooling plate is in direct thermal communication with the load side of the thermoelectric modules. The heat side of the thermoelectric modules is in direct thermal communication with a heat exchange assembly comprised of a base plate and downwardly projecting fins for transferring heat to a heat exchange fluid, such as air. The heat exchange fluid is caused to flow past the fins of the heat exchange assembly either by natural convection or by forced air circulation in response to one or more fans for forcing air past the heat exchange fins. Although the fan means may be located almost anywhere in relation to the heat exchange assembly, it is located preferably adjacent to and beneath the fins of the heat exchange assembly. Current may be supplied either continuously or intermittently to the thermal modules in a direction that causes heat to be absorbed from the cooling tray and released to the heat exchange assembly. The rate of heat transfer is sufficient to freeze the liquid water and form ice cubes within the compartments of the ice bag. In this specification, "ice cubes" refers to the bodies of ice formed in the bag compartments regardless of their actual shape, i.e., shapes other than cubical are contemplated and an oval like shape is preferred for the economy of bag construction.

In a preferred embodiment, the housing has a hollow interior forming a freezing compartment and comprises a metal cooling tray, preferably of aluminum, and five insulated wall sections each having a foamed plastic core surrounded by an outer casing of relatively dense plastic. The insulated walls of the housing are preferably of a molded construction and two sidewall sections and the front and rear wall sections are molded preferably as an integral unit. The top wall section is preferably molded as a separate unit and hinged to the rear wall section of the housing by hinges or other conventional pivotal type fastenings so as to form a pivotally mounted door providing access to the freezing compartment. The ice maker door is arranged for pivotal opening and closing movement preferably through at least 45° of arc in going from its closed position to its open position. More preferably, the door is mounted for pivotal movement relative to the remainder of the housing through at least 90° of arc, more preferably at least about 150° of arc so that the door can come to rest in a self-supporting vertical position while the cooling tray and the rest of the housing are mounted in a slanted position relative to the horizontal. This slanted housing arrangement reduces the depth of the unit, i.e., the horizontal distance that the unit projects into a room or other space from a wall mounting.

The access door formed by the top wall of the housing includes sealing strips of conventional design around the edges of the door casing for engaging the adjacent side, front and rear sections of the insulated housing. The upper edges of these sections form a door frame around a door opening into the freezing compartment. These strips may be of conventional design and form a heat seal between the edges of the door and the adjacent edges of the door frame when the door is in its closed position. The sealing strips may comprise rib-like extensions of the molded plastic casing of the door and may be formed integrally with this casing. However, the door seals may also comprise separate pieces of sealing strip secured adjacent to each edge of the door and may be of a plastic or elastomeric material different from that of the door casing. A door fastener or latch with one element on the door and a cooperating element on an adjacent portion of the housing may be used to secure the door in a firmly closed and sealed position. The invention also preferably includes an uninsulated frame for mounting the insulated housing, the cooling tray, the thermocouples, the fan(s) and the other electrical and mechanical components of the ice maker.

A particularly important feature of the present invention is the compartmented ice bag which is formed from thin sheets or tubes of plastic material, such as polyethylene, polyvinyl chloride or other thin-film plastic material. Although the plastic film may be any color desired, clear plastic is preferred to permit observation of completion of ice formation within the bag. Polyvinyl chloride composition is preferred because its dipolar composition has good heat sealing characteristics upon exposure to dielectric heating devices of the type that may be used for welding so as to adhere the plastic sheets or tube walls together as described further below. This heat welding is done preferably by dielectric heating with high frequency radiant energy, although other types of heat welding or sealing may be used such as ultrasonic or hot press sealing. The layers also may be adhered together by adhesion means other than heat welding, such as solvent welding or by a layer of adhesive. Solvent welding involves swabbing opposing sides of the film sheets with a solvent for the film material, such as hexyl or isohexyl alcohol where the sheets are of a polyvinyl chloride resin. Similarly, one or both opposing surfaces of the sheets may be coated with an adhesive composition that causes the sheets to adhere tightly together.

In a preferred embodiment of the invention, a conventional plastic bag having a zip-locked structure at one end is placed between a heat welding platen and a heat welding probe and the opposing walls while in a collapsed condition are heat welded together so as to form individual ice compartments, each the size of the ice cubes desired. The ice bag preferably has 15 to 30 compartments, more preferably 18 to 24 compartments arranged in three parallel rows extending longitudinally from the top to the bottom of the bag. The shape selected for the water filled compartments of the bag is preferably one that is relatively unaffected by the position of the bag in-between the horizontal and the vertical. This allows the freezer compartment tray to be positioned at any angle relative to the horizontal so that its depth or width dimension may be slanted relative to the horizontal as indicated above. The ice bag can even be positioned vertically such that the ice maker housing can be placed in a variety of positions, depending on the size and shape of the space available for its installation.

The ice cube compartments in each row are interconnected with the next successive compartment and the last compartment in each row is interconnected with the last compartment in an adjacent row by water passages. The first compartment in each row is adjacent to the inlet of the bag and is interconnected with the inlet or fill opening of the bag . This inlet is surrounded by a conventional zip-lock closure structure. "Interconnected" as used in this specification means that the two volumes referred to are in fluid communication with each other. When a bag having the interconnected compartments described is filled with water, the water may travel down one row of compartments and then up an adjacent row of compartments so as to fill each compartment in succession with air being expelled from the top of a different row from that which the water is entering. This ensures that all of the compartments are filled completely with water without trapping air in any of the compartments. When all of the compartments of the bag are filled with water, the zip-locked top is then sealed in conventional fashion and the bag placed in the freezing compartment of the ice maker.

After the water filled bag has been placed in the freezing compartment, the door of the compartment is closed and current is supplied to the thermoelectric modules to remove heat from the freezing compartment and freeze the water so as to make an ice cube in each of the compartments of the ice bag. The number of thermoelectric modules and the capacity of the heat exchange assembly and associated fan means are selected so that the time required to freeze a new batch of ice is preferably less than 60 minutes, more preferably less than 40 minutes and still more preferably less than about 30 minutes. Commencement of the freezing cycle may be initiated by a switch (not shown) actuated by closure of the door. Alternatively, an actuating switch may be located on an external surface of the ice maker housing and may be actuated manually or by the use of a special key, such as where a fee is to be charged for possession of the key. The activating switch may also be coin operated so that it is actuated in response to insertion of a coin in a coin slot of the switch.

When the water in the compartmented bag has frozen, the amount of electrical energy used in keeping the ice frozen can be conserved by the use of a thermostat and associated electrical circuitry to cycle on and off the fan means and/or the thermoelectric modules. The temperature range selected for the thermostat and the actuating sequence of the thermoelectric modules and fan(s) are selected so as to minimize energy consumption while maintaining the compartmented ice cubes in a solidly frozen condition within the freezing compartment. Depending on the capacity of a heat exchange assembly capable of using natural convection flow of the heat removal medium, it may be possible to maintain the frozen condition of the compartmented ice cubes by cycling on and off all or only a portion of the thermoelectric modules with the fan means deactivated. This latter cycling arrangement may result in substantial savings in electrical energy while conveniently providing a small batch of sanitary ice for immediate use.

When ice is desired, the door of the ice maker is opened and the ice bag is removed and subsequently torn apart so as to expose only the number of ice cubes desired for immediate use. The plastic film used for the bag walls has a thickness of preferably about 1 to 4 mils, more preferably about 2 mils, in order to be easily rupturable by hand. The areas of the bag walls that are welded together to define the ice compartments are preferably embossed with a pattern of indentations or holes to facilitate tearing of these areas of the bag by hand. Should only a portion of the ice cubes be needed, the remainder may be left enclosed in their individual compartments and the partially used bag returned to the freezing compartment of the ice maker for later use. If the entire bag is used, a new bag may be obtained from a nearby source of supply, such as a dispensing rack mounted on an exterior surface of the ice maker cabinet. The new bag is then filled with water, sealed and returned to the freezing compartment of the ice maker either by the person using the ice, service personnel or a subsequent occupant of the room or other area in which the ice maker is installed.

When the ice cubes have frozen but before removal of the bag from the ice maker, the individual ice cubes are attached together by thin columns of ice formed within the passageways between adjoining ice cube compartments. A slight bending of the flexible wall bag is sufficient to break these thin ice columns so that individual ice cubes of the desired number can be removed while leaving the remainder secured within unruptured compartments of the bag.

BRIEF DESCRIPTION OF THE DRAWINGS

The invention may be further understood by reference to the description below of its best mode and other specific embodiments taken in conjunction with the accompanying drawings in which:

FIG. 3 is a fragmentary view of the freezing compartment and associated cooling and heat exchange components as shown in section taken along lines 3—3 of FIG. 2.

FIG. 4 is a plan view of the compartmented ice bag of the invention.

FIG. 5 is a fragmentary elevational view of ice cubes within two interconnected compartments of the ice bag as shown in section taken along lines 5—5 of FIG. 4.

FIG. 6 is a diagrammatic elevational view illustrating installation of the ice maker of the invention on the wall of a motel or hotel room or the like.

DESCRIPTION OF BEST MODE AND OTHER EMBODIMENTS

Figure 1:
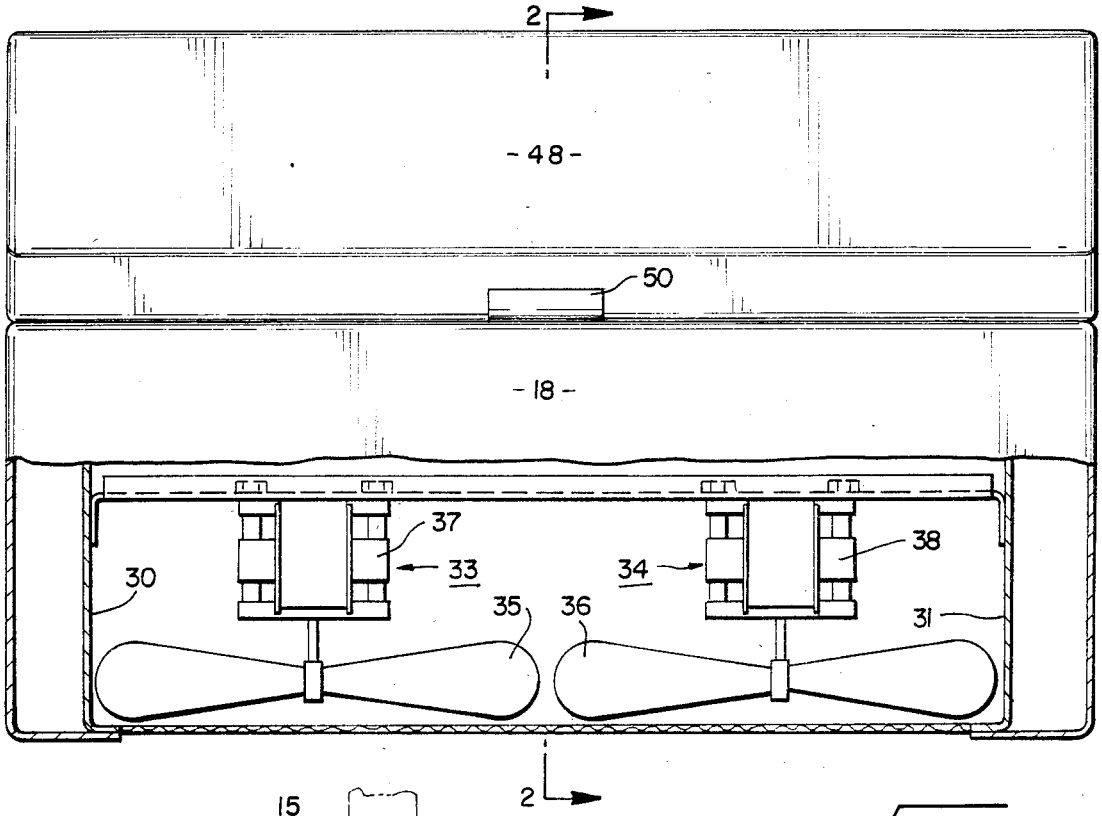
FIG. 1 is a front elevational view of the invention as shown in partial section.
Figure 2:
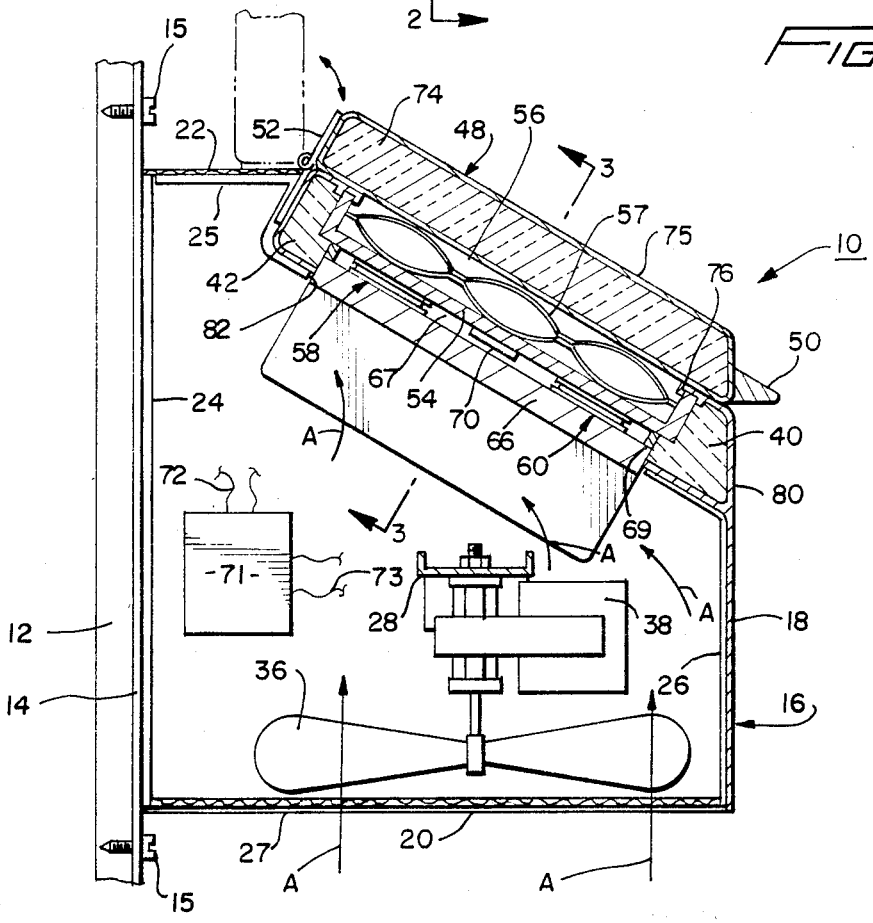
FIG. 2 is a side elevational view of the invention as shown in section taken along lines 2—2 of FIG. 1.

Referring to FIGS. 1-3 of the drawings, an insulated housing 10 is mounted on a supporting wall 12 by means of a cabinet structure generally designated 16. Cabinet 16 includes a mounting plate 14 and screws 15. Plate 14 comprises the rear wall of cabinet 16 which also includes a decorative front wall 18, a bottom wall comprising an air inlet screen 20, and a top wall comprising an air outlet screen 22. Screens 20 and 22 may be of a wire mesh or of an expanded metal lattice work. Pairs of internal metal frame struts 24, 25, 26 and 27 provide mounting frames supporting rear plate 14, top screen 22, front wall 18 and bottom screen 22, respectively. These struts also support opposing housing sidewalls 29—29 and internal baffle walls 30 and 31. A metal mounting bracket 28 extends between opposing baffle walls 30 and 31 and provides a support for mounting a pair of fans 33 and 34 having fan blades 35 and 36 driven by AC motors 37 and 38, respectively.

Wall 12 may be the wall of a bathroom or some other wall in a hotel or motel room. At this location, the ice maker may be conveniently connected to a standard 120 volt electrical wall outlet as illustrated in FIG. 6. Although a water tap could be provided adjacent to the ice maker, the ice maker may be located remotely from a water tap since the compartmented ice bags are easily transported to and from a remote water tap, such as that associated with a bathroom sink, tub or the like.

Insulated housing 10 has a front wall 40 and a rear wall 42 as shown in FIG. 2, and opposing sidewalls 44 and 46 as shown in FIG. 3. A top wall comprises a door 48 having a handle 50 along its front side and pivotally connected to frame members 25 along its rear side by a hinge 52. The bottom wall of housing 10 comprises an aluminum cooling tray 54 which may be just a rectangular plate but preferably includes front and rear walls and interconnecting sidewalls in addition to a bottom wall. The front, rear and sidewalls extend upwardly from the bottom wall adjacent to the corresponding walls of insulated housing 10.

Tray 54 cooperates with door 48 to form a freezing chamber 56 for holding a compartmented ice bag 57. Secured to the bottom surface of cooling tray 54 are two rows 58 and 60 each comprised of six thermoelectric modules or units 61. Each thermoelectric module 61 absorbs heat from cooling tray 54 through a thin plate 62 on its load side and transfers this heat to a heat exchange assembly through a thin plate 64 on its sink side. Load plate 62 is in direct thermal communication with the bottom of metal cooling tray 54 and sink plate 64 is in direct thermal communication with an adjacent, relatively thick base plate 66 carrying a plurality of outwardly projecting fins 68 for transferring heat to a flow of air that is caused to move across fins 68 by fans 33 and 34. A heat conductive grease is preferably used between load plate 62 and cooling tray 54 and between sink plate 64 and base plate 66 so as to ensure good thermal contact of the thermoelectric modules with the cooling tray on one side and with the base plate on the other side. This direct thermal communication provides efficient heat removal so that the time required to convert liquid water to ice is minimized. With water temperatures in a normal range of about 65° F. to 75° F., the number and capacity of modules 61 are preferably selected so that the time required for the ice maker to freeze a new batch of ice is only about 30 minutes or less.

Each of the thermoelectric modules in rows 58 and 60 includes a plurality of thermocouples comprised of alternating P and N type thermoelectric semi-conductor bodies (not shown) connected together in a conventional manner. One example of a commercially available thermoelectric module that can be employed satisfactorily in the present invention is model CP 1.4-127-06 manufactured by Materials Electronic Products Corporation of Trenton, N.J. This a low current, moderate capacity module suitable for use with a 12 volt DC current. The module contains 127 thermocouples, each of which is about 0.06 inches in length and about 1.4 millimeters square in cross-section. The thermoelectric material is a quaternary alloy of bismuth, tellurum, selinium, and antimony with small amounts of suitable dopants. This alloy is processed so as to produce an oriented polycrystalline ingot with anisotropic thermoelectric properties. The thermocouples are sandwiched between metallized ceramic plates affording good electrical insulation and thermal conduction.

During the time that current is supplied to the thermoelectric modules by a conventional electrical system (not shown), the fans 33 and 34 may operate continuously or intermittently to force air past heat exchange fins 68 in the direction of arrows A so as to remove heat from base plate 66 by forced air convection. Cool ambient air enters air inlet grill 20 beneath fans 33 and 34, and then flows upwardly and inwardly across heat exchange fins 68. The heated air then flows upwardly so as to be discharged from cabinet 16 through air outlet grill 22. During the ice freezing cycle, fans 33 and 34 operate continuously to provide the forced air convection needed for rapid cooling and freezing of the water held within the individual compartments of ice bag 57.

Completion of a freezing cycle is detected by a thermostat 70 which preferably is electrically connected to a controller 71 in the electrical system (not shown) of the ice maker so as to convert thermoelectric modules 58 and 60 to an intermittent type of cooling operation when all of the water in the ice bag has frozen. Controller 71 is connected to thermostat 70 by electrical wires 72 and to fan motors 37 and 38 by electrical wires 73. Thermostat 70 is preferably located within or on the bottom of cooling tray 54 as shown in FIG. 2, and is preferably set so as to activate a freezing cycle at a temperature in the range of about preferably about 32° F. to about 34° F. and to deactivate this freezing cycle when the freezing compartment temperature is lowered into the range of about 20° F. to about 30° F., preferably about 22° F. to about 26° F. and more preferably about 25° F. Thereafter, the controller converts the thermoelectric modules and fans to an intermittent cooling operation in which the thermoelectric modules and fans are turned on at a temperature in the range of preferably about 30° F. to about 31° F. and turned off when the freezing compartment temperature is lowered to preferably about 26° F. to about 27° F.

During cyclic operation of the freezing unit to maintain the frozen condition of ice within the ice bag, fans 33 and 34 are preferably activated only during the periods that cooling current is supplied to the thermoelectric modules. These fans are preferably shut off at all other times to save energy consumption. An alternative to further conserve energy consumption is to cut off the fans entirely or to operate only one of them intermittently when cooling current is supplied to the thermoelectric modules during the ice maintaining cycle. Depending on the size of the heat exchange fins relative to the number, size and capacity of the thermoelectric modules and also on the size and arrangement of the cabinet enclosure surrounding the heat exchange fins, there may be sufficient natural convection to remove the amount of heat necessary to maintain the frozen ice in that condition with no or relatively little fan operation. When natural convection is to be relied on for maintenance cooling, an alternative operating sequence would be to activate the thermoelectric modules at a first level of about 28° F., followed if necessary by activation of at least one fan at a second level of about 30° F., followed if necessary by activation of the second fan at a third level of about 31° F. to ensure that the ice is kept frozen and/or that the thermoelectric modules do not overheat. Another alternative is to provide intermittent operation of the thermoelectric modules either alone or in combination with continuous or intermittent operation one or both of the fans.

Upon removal of the ice filled bag for use, a partially filled bag may be returned to the freezer compartment and kept frozen by the ice maintenance cycle of the ice machine. However, if a new bag filled with room temperature water is placed in the freezing compartment 56, the temperature of tray 34 will rise above 32° F. and in response to this higher temperature, the controller in the electrical system again initiates the freezing cycle so as to make a new batch of ice. During the freezing cycle, the thermoelectric modules and the heat removal fans are operated continuously until all of the water in the ice bag is again frozen as indicated by a signal from thermostat 70 indicating that it has detected a temperature of less than about 25° F., at which point thermostat 70 closes and thereby signals the controller to commence one of the ice maintenance cycles described above. Continuous operation of the heat removing components in their freezing mode is capable of rapidly providing a supply of new ice within 30 to 40 minutes.

Door 48 is preferably comprised of a plastic foam core 74 and a relatively dense outer plastic casing 75. The front wall 40, rear wall 42, and sidewalls 44 and 46 of insulated housing 10 are similarly comprised of a plastic foam core and a relatively dense outer plastic casing. The inner edge of the front and rear walls and the sidewalls preferably includes a sealing lip 76 which overlays the upper rim 78 of tray 54 and sealingly engages the underside of door 48 as shown in FIGS. 2 and 3. The sealing lip 76 preferably extends all the way around rim 78 in sealing contact with the door near its outer edge so as to prevent significant leakage of ambient air around the door and into freezing chamber 56. Sealing lip 76 is relatively flexible and defines the door opening into chamber 56 so as to provide a good thermal seal between each edge of the door and the door opening. Although seal 76 is preferably an extension of the wall casing 80, it may instead comprise separate pieces of elastomeric material extending along each upper edge of tray 54 or it may be a single piece of elastomeric material extending entirely around the door opening. As a further alternative, seal 76 may comprise an extension of door casing 75 or a separate piece or pieces secured to the door near its peripheral edge so as to sealingly engage abutting portions of housing walls 40, 42, 44 and 46.

The door and wall sections of housing 10 are preferably molded from conventional plastic core and casing materials. The wall casing may be molded separately and then filled with an insulating foam. However, both the casing and the foam core are preferably of the same plastic material and are formed together as part of an integral molding process.

Although each section of the housing may comprise a separate panel, front wall 40, rear wall 42 and sidewalls 44 and 46 are preferably molded as a single, integral housing unit. In this preferred embodiment, the integral housing unit is molded around cooling tray 54 so that it is permanently held in position within the housing unit. The thermoelectric modules, base plate and cooling fins are then secured to this tray portion of the housing.

The metal frame members 25 and 26 of cabinet 16 define an opening 82 for receiving and supporting housing 10 as shown in FIG. 2. To enhance air circulation within cabinet 16, there is preferably provided internal walls 30 and 31 which serve as air ducting to funnel air from fans 33 and 34 past the heat exchange fins 68. These walls are positioned closely adjacent to the sides of heat exchanger fins 68 as shown best in FIG. 3 so that substantially all fresh air must pass upwardly between the fins in order to be exhausted through outlet grill 22.

Housing 10 is easily removable from cabinet opening 82 so as to provide easy access for maintenance of fans 33 and 34 and other components of the electrical system of the ice maker which are preferably housed within the hollow interior of cabinet 16. These components may be mounted on one or more of the cabinet walls 24, 26, 30 and 31. Access opening 82 thereby permits work on the mechanical and electrical equipment of the ice maker without having to remove cabinet 16 from its wall mounting.

A particularly important feature of the invention is the structure of compartmented ice bag 57. This ice bag is preferably made from a thin-film plastic bag having a reclosable mouth of the type employed in the home as freezer or refrigeration bags for the temporary storage of foods. The reclosable structure is sometimes referred to as a "zip-lock" and one such bag is disclosed in U.S. Pat. No. 29,331 reissued Aug. 2, 1977, the entire contents of which are incorporated herein by reference. These bags have a single interior compartment defined by unadhered opposing walls and comprise the starting material or blank from which the compartmented freezer bags of the present invention are made.

Each preformed bag blank is placed between opposing platens of a heat welding mold, each platen having half compartment recesses and a molding face corresponding to the configuration of the compartmented bag shown in FIG. 4. In other words, the recesses correspond to the bag compartments 86 and interconnecting passages 87, and abutting surfaces of the molding faces correspond to the heat welded areas 88 over which opposing bag walls are welded together so as to form the compartments 86 and interconnecting passageways 87. The abutting areas of the platens are preferably embossed so as to form a pattern of small indentations, such as at 90, in the heat welded wall areas 88. The embossed indentations 90 reduce the wall thickness of the two welded together layers of wall material so that the tearing force required to rupture the bag compartments is less than would otherwise be required to tear a double thickness of the bag wall without such embossing. It may also be desirable in some instances for the embossing to actually produce an aligned series of apertures through the bag wall so as to permit tearing the bag compartments apart along a clearly defined tear line.

The bag mouth or entrance opening 92 is closed by a conventional zip-lock structure 94. Although any number of longitudinal and transverse rows of compartments may be utilized, a preferred embodiment of the invention is comprised of three longitudinal rows R1, R2 and R3 each containing seven individual ice compartments. The individual compartments in each row are interconnected through longitudinal water passageways 87 and the last or bottom compartment of each row is interconnected by transverse water passageways 95 to form a transverse row RA. Except for transverse passageways 95 between compartments in transverse row RA, there are no transverse interconnections between the other compartments of adjoining rows. This arrangement of interconnected compartments and rows is advantageous in filling the compartmented bag 57 while at the same time venting air from each successive compartment. For example, if the bag is filled from a water tap placed immediately above row R2, water enters through inlet passage 96 and successively fills each compartment of row R2 in the direction of arrows FI, air being vented from the bottom of row R2 through transverse row RA in the direction of arrows FA and through adjoining rows R1 and R3 in the direction of arrows FO. The top passageways 98 and 99 of rows R1 and R3, respectively, thus serve as outlets for venting air forced out of the bag by water entering inlet passageway 96 of row R2. Passage 96 is preferably tapered as at 97 to provide a wider mouth. After reaching the last compartment in row R2, the water then flows in the direction of arrows FA and FO to successively fill each of the compartments in rows R1 and R3 from the bottom to the top of the bag. Bag opening 92 with its zip-lock 94 defines the top end of the bag for purposes of this specification.

After all of the compartments of the bag have been filled completely and substantially all of the air has been expelled through the uppermost passageways 98 and 99, mouth 92 of the bag is closed by compressing opposing sides of the zip-lock structure 94 together in conventional fashion. The water fi11ed bag is then placed in freezing compartment 56 and the liquid water converted to ice. The ice cubes made conform to the shape of the individual bag compartments, which are preferably oval as illustrated in FIG. 5. FIG. 5 shows two ice cubes 100 and 101 interconnected by a thin column of ice 102 formed by the freezing of water within interconnecting passage 87. Ice columns 102 are very fragile and are easily broken by flexure of the flexible bag 57 upon its removal from the freezing compartment to dispense the ice. Due to the tear indentations 90 and the fragile nature of ice columns 102, a single ice cube or one or more transverse rows of ice cubes may be torn away without rupturing the remaining portion of the ice bag package. Thus, only the amount of ice needed at any given time can be removed from the ice bag structure without contaminating the remaining ice cubes which may be returned to the freezing compartment of the ice maker for future use.

The introduction of ice bag 57 containing ambient temperature water into freezing compartment 56 raises the temperature of the cooling tray 54 as detected by thermostat 70. When this temperature reaches a range.of about 30° F. to about 34° F., preferably about 32° F. to about 33° F., thermostat 70 actuates the electrical system so as to turn on all of the thermoelectric modules and both of the fans. Thermostat 70 is also preferably set so as to deactivate this freezing cycle by turning off the thermoelectric modules and the fans when the freezing chamber temperature is lowered to preferably about 25° F. to about 26 ° F. Thereafter, the ice maintenance cycle is commenced which may involve intermittent operation of a sufficient number of thermoelectric modules and sufficient fan operation to maintain the temperature of the freezing chamber less than about 31° F., more preferably less than about 30° F. In a preferred embodiment, all of the thermoelectric modules and one fan are activated together intermittently so as to cycle the freezing compartment temperature between a lower limit of about 28° F. and an upper limit of about 30° F. during the ice maintenance cycle.

As shown in FIG. 6, there optionally may be provided a light 105 on the exterior of cabinet 16 which is activated when the ice maintenance cycle begins so as to give a visual indication that the ice in compartmented bag 57 is ready for use. A further optional provision (not shown) is a solenoid actuated latch to prevent opening of door 48 unless the light circuit is activated so as to prevent the opening of door 48 until the water within the ice bag is fully frozen and ready to be dispensed as ice cubes.

The electrical system of the ice maker preferably is connected to a standard 110–120 volt AC outlet by means of a heavy duty electrical cord 107. Actuation of the electrical system and/or a latch for door 48 may be made responsive to either a key operated switch 109 or a coin operated switch within a coin box 111. Although shown mounted externally, coin box 111 could also be mounted internally within cabinet 16. The key for operating switch 109 could be a hotel or motel room key or a special key for which a fee might be charged. Switch 109 instead may comprise a simple toggle or button type manual switch on the exterior of cabinet 16.

Although the power supply and components for these switches and for the electrical system of the ice maker are not shown for purposes of simplicity, these components are preferably housed within the hollow interior of cabinet 16. The circuit supplying electrical power to the thermoelectric modules and fans may also include an interlock (not shown) for preventing actuation of these components unless door 48 is in its closed position. A key operated latch may also be provided for door 48 so as to prevent access to freezing chamber 56 by anyone other than the holder of the corresponding key so as to ensure that any previously frozen ice remains contaminate free.

Another important feature of the invention is that the space 67 between the bottom of tray 54 and heat exchanger base plate 66 is sealed against moisture so as to prevent deterioration and/or short circuiting of the module thermocouples by exposure to water. Referring to FIG. 2, all form edges of base plate 66 are pressed against corresponding sides of an annular gasket 69 of a water impermeable, compressible material, such as cork or an elastomeric material. This gasket is preferably coated with a silicone sealant so as to further isolate the thermoelectric modules from moisture. When base plate 66 is mounted on the plate comprising the bottom of tray 54, these two plates are tightened against each other so as to compress and seal gasket 69 therebetween. This compression and the sealing action is provided by mounting screws (not shown) which pass through base 66 and are threaded into the bottom of tray 54. In addition, individual thermoelectric modules 61 are coated with a surrounding layer of thermal grease that helps seal the module thermocouples against moisture and also facilitates thermal communication between load side plate 62 and tray 54 and sink side plate 64 and heat exchanger base plate 66.

In a particularly preferred embodiment of the invention, ice bag 57 has an overall length of approximately 13 inches and a width of approximately 5 inches, and the opposing sidewalls of the bag are each about 2 mils thick. The heat sealing platens used to compartmentalize the bag are formed so as to provide 21 ice compartments in three rows, each compartment having a diameter of 1½ inches. The center of each compartment is spaced from the center of the next successive compartment in the same row by a distance of about 1 11/16 inches and the longitudinal axis of each row of compartments is spaced about 1⅝ inches from the next adjacent row. Zip-lock 94 may have a closable interlocking structure, such as that illustrated in U.S. Pat. No. Re. 29,331 reissued to Naito on Aug. 2, 1977. The zip-lock 94 is about ⅝ inch from the inlet edge of the bag and the center of the first compartment of each row is about 1 inch from the zip-lock. The bottom edge of the bag is about 1 inch from the center of the last or bottom compartment of each row. The inlet passages 98 and 99 and the passages 87 interconnecting the individual compartments are about ⅝ inch wide. The fill opening 96 into the first compartment of row R2 is preferably 1 inch wide and this entrance passage is tapered outwardly at a diverging angle of about 60° as best seen in FIG. 4.

Ice bag 57 fits snuggly within an aluminum cooling tray 54 having inside dimensions of about 5⅜ inches in width, about 12¾ inches length, and about 9/16 inch in depth. The depth of the tray is sufficient to receive the thickness of the ice bag in transverse section as shown in FIGS. 2 and 3, this thickness being about ½ inch. The bottom and sidewalls of the cooling tray preferably have a thickness of about 3/16 inch. Housing door 48 has a width of about 6⅜ inches and a length of about 13⅛ inches. The thickness of door 48 is about ⅞ inch and the thickness of the housing walls is about ½ inch. Housing 16 has an overall height along its rear face of about 8⅜ inches, an overall length of about 14⅛ inches and a projecting depth of about 7½ inches from the wall surface on which it is mounted. The base plate of the heat exchanger assembly is preferably about 5 inches wide, 12 inches long and ⅜ inch in thickness. The length of the heat exchanger fins is about the same as the inside width of the cooling tray, namely, 5 inches, and the fins project downwardly from the base plate in the direction normal thereto for a distance of about 1½ inches. The thickness of each fin is about 1/32 inch.

INDUSTRIAL APPLICABILITY

The present invention employs a miniaturized refrigeration system which relies upon efficient thermoelectric modules in direct contact with a heat exchange assembly on one side and a cooling tray on the other side. The tray is surrounded on five sides by insulating walls. Individual ice cubes are molded in the shape that water is held in within individual ice compartments of an ice bag made from thin-film flexible plastic material. The invention provides a compact ice cube maker of such reduced size as to permit personalized use in offices and hotel and motel rooms and in boats, airplanes, trucks, cars, trailers and other vehicles. The water from which the ice is made and the ice cubes after they are frozen are sealed within a plastic bag so that the ice cubes remain in a sanitary condition until the bag is ruptured to dispense the ice cubes for use. Both the cooling tray and the heat exchanger assembly cooperate with the thermoelectric modules in a manner that ensures efficient pumping of heat from water in the ice bag compartments to a heat exchange fluid flowing past the heat exchanger. The heat transfer efficiency of the thermoelectric modules is optimized by direct attachment of their load side to the cooling tray and direct attachment of their sink side to a base plate of the heat exchanger assembly. Rapid heat removal from the freezing chamber within the tray is provided by a plurality of thermoelectric modules in intimate contact with the cooling tray, and rapid heat dissipation is provided by a large fin surface area and dual cooling fans for moving air rapidly past the fin surface area.

The insulated housing portion of the ice maker is easily removable from an ice maker cabinet to provide easy access to electrical and mechanical components within the ice maker cabinet. The ice maker cabinet includes a decorative cover and a sturdy frame is provided for mounting both the insulated housing and the decorative cabinet cover on the wall of a hotel, motel or the like. The ice maker does not require any connections to water conduits and uses a standard electrical wall outlet.

What is claimed is:

1. An ice making apparatus comprising:

mold means for holding a plurality of bodies of liquid water each in the shape of an ice cube, said mold means comprising a bag of thin-film plastic material having opposing walls adhered together along areas of adhesion so as to form a plurality of ice compartments each interconnected to at least one other compartment by a water passageway, said bag having an inlet means for introducing water into at least one of said interconnected compartments and closure means for closing said inlet means so as to seal water within said compartments;

a cooling member of heat conductive material for supporting said bag and conducting heat away from water within said bag compartments;

thermoelectric means for cooling said cooling member so as to freeze at least a portion of said bodies of liquid water and form ice in said bag compartments, said thermoelectric means including thermoelectric modules in thermal communication with a heat exchange assembly for transferring heat from said thermoelectric modules to a heat exchange medium, and fan means for moving said heat exchange medium past heat exchange surfaces of said heat exchange assembly;

an insulated housing extending around at least a portion of said cooling member and cooperating with said member to define a freezing chamber for said bag, said housing including means for causing natural convection flow of said heat exchange medium past the heat exchange surfaces of said heat exchange assembly, the capacities of said thermoelectric modules and said heat exchange assembly in the presence of said natural convection flow being sufficient to maintain previously frozen ice in the compartments of said ice bag in a frozen condition without continuous operation of said fan means; and, support means for supporting said cooling member and said insulated housing on a support member.

2. The apparatus of claim 1 in which said ice molding compartments are arranged in at least a first row and each compartment in said first row is interconnected by a water passageway to another compartment in said first row, and said inlet means introduces water into the first compartment at one end of said first row, and in which said mold means further includes vent means for venting air from the last compartment at the other end of said first row.

3. The apparatus of claim 2 in which said vent means includes at least a second row of said compartments each interconnected to an adjacent compartment by a water passageway, the last compartment at one end of said second row being connected to the compartment of said first row by a water passageway, the first compartment at the other end of said second row having a vent passageway for venting air from said bag, and said interconnecting water passageways being arranged so that water from said inlet means flows through successive compartments from the first to the last compartment of said first row, from the last compartment of said first row to the last compartment of said second row, and from the last to the first compartment of said second row.

4. The apparatus of claim 3 in which said inlet means includes an inlet opening and said vent means includes a vent opening and said inlet opening and said vent opening are sealed by means of a reclosable structure along a mouth at one end of the bag.

5. The apparatus of claim 1 in which said areas of adhesion are formed by heat welding together selected portions of said opposing bag walls.

6. The apparatus of claim 1 in which said areas of adhesion are formed by adhering together selected portions of said opposing bag walls by means of an adhesive composition.

7. The apparatus of claim 1 in which said areas of adhesion are formed by adhering together selected portions of said opposing bag walls by means of solvent welding.

8. The apparatus of claim 1 in which said cooling member has a planar surface for supporting said bag.

9. The apparatus of claim 8 in which said planar surface is positioned at an acute angle relative to the horizontal.

10. The apparatus of claim 1 in which said insulated housing has an upper wall of insulating material mounted for movement relative to the remainder of said housing so as to form a door providing access into said freezing chamber.

11. The apparatus of claim 10 which further includes seal means for engaging said door and the edges of a door opening into said freezing chamber so as to provide a heat seal between the edges of said door and the edges of said door opening when said door is in its closed position.

12. The apparatus of claim 1 in which said thermoelectric means includes a heat exchange assembly having heat exchange fins projecting into a heat exchange medium, and fan means for moving said heat exchange medium past said heat exchange fins.

13. The apparatus of claim 12 in which said fan means is arranged for continuous operation during a freezing cycle for changing liquid water to ice in the compartments of said plastic bag, and said heat exchange fins are sized and arranged relative to a baffle means so that sufficient heat exchange medium passes over said heat exchange fins to remove from said cooling member at least the amount of heat required to maintain previously frozen ice in said bag compartments in a frozen condition without operation of said fan means or with operation of said fan means only intermittently.

14. The apparatus of claim 1 in which said insulated housing is of molded plastic and the wall(s) of said housing comprises a foam plastic core surrounded by an outer casing of relatively dense plastic.

15. The apparatus of claim 1 in which said insulated housing is of molded plastic, and in which said cooling member is a tray having front, rear and sidewalls surrounded by an integrally molded wall of said housing.

16. The apparatus of claim 1 in which said cooling member is of heat conductive material and has at least one horizontally extending heat transfer surface, and in which said thermoelectric means includes at least one thermoelectric module with a load side and a heat sink side, said load side being in direct thermal communication with said heat transfer surface and said heat sink side being in direct thermal communication with a heat exchange means for transferring heat to a heat exchange medium flowing past a heat exchange surface of said heat exchange means.

17. The apparatus of claim 1 in which said thermoelectric means includes a plurality of thermoelectric modules and control means for causing actuation of said thermoelectric modules so as to form ice cubes by freezing water in the compartments of said ice molding bag, said control means including a thermostat in thermal communication with said cooling member and means for providing electrical current to said thermal electric modules in response to a signal generated by said thermostat when it detects a preselected temperature of said cooling member.

18. The apparatus of claim 1 in which said thermoelectric means includes at least one thermoelectric module with a load side in direct thermal communication with said cooling member and a heat sink side in direct thermal communication with a plate of heat conductive material for transferring heat from said sink side to a heat exchange fluid, one side of said cooling member and one side of said base plate providing opposing sidewalls of a chamber for said at least one thermoelectric module, and in which said apparatus further includes gasket means extending along a peripheral edge portion of said chamber between said sidewalls so as to seal said thermoelectric module within said chamber and prevent ambient moisture from entering said sealed chamber.

19. The apparatus of claim 1 in which said natural convection flow is sufficient to maintain previously frozen ice in the compartments of said ice bag in a frozen condition without operation of said fan means after said ice is formed in said bag compartments.

20. An ice making apparatus comprising:

mold means for holding a plurality of bodies of liquid water each in the shape of an ice cube, said mold means comprising a bag of flexible thin-film plastic material having opposing walls forming a plurality of ice molding compartments each interconnected to at least one other compartment by a water passageway, said bag having an inlet means for introducing water into at least one of said interconnected compartments, closure means for closing said inlet means so as to seal water within said compartments, and at least one row comprising a plurality of compartments extending in a length direction of said bag;

a cooling member of heat conductive material for contacting said bag and conducting heat away from water within said bag compartments, said cooling member having an elongated cooling surface for contacting said bag in an elongated freezing chamber so that the length direction of said bag corresponds to the elongated direction of said cooling surface, and said cooling surface being slanted transversely at an acute angle relative to the horizontal and a width direction of said bag being at a corresponding acute angle relative to the horizontal;

means for cooling said cooling member so as to freeze at least a portion of said bodies of liquid water and form ice in said bag compartments, said cooling means including a heat exchange assembly for transferring heat from said cooling member to a heat exchange medium, said heat exchange assembly having a heat exchange surface slanted at an acute angle relative to the horizontal to cause natural convection flow of said heat exchange medium past said heat exchange assembly;

an insulated housing extending around at least a portion of said cooling member and cooperating with said cooling member to define said elongated freezing chamber for said bag; and, support means for supporting said cooling member and said insulated housing on a support member, said slant of said cooling surface and said slant of said heat exchange surface providing a horizontal projection of said housing that is substantially less than if said surfaces were disposed horizontally, and said support means including means for supplying natural convection flow of said heat exchange medium to said slanted heat exchange surface of said heat exchange assembly.

21. The apparatus of claim 20 in which said cooling member provides a bottom wall for said freezing chamber and said insulated housing includes an insulated door providing at least a portion of a top wall for said freezing chamber, and in which said bottom wall is spaced from said top wall such that contact of said bottom wall with one of said opposing bag walls and contact of said top wall with the other of said opposing bag walls causes a distribution of liquid water between said bag compartments that provides ice cubes of substantially uniform thickness.

22. The apparatus of claim 21 in which said bottom wall and said top wall each have a planar surface for contacting said opposing bag walls and said planar surfaces are positioned at an acute angle relative to the horizontal, said acute angle being substantially the same for each of said planar surfaces.

23. The apparatus of claim 20 in which said slanted heat exchange surface and said slanted cooling surface are substantially parallel and are slanted at an acute angle of about 15° to about 60° relative to the horizontal.

24. The apparatus of claim 20 in which said slanted heat exchange surface and said slanted cooling surface are substantially parallel and are slanted at an acute angle of about 30° to about 45° relative to the horizontal.

25. The apparatus of claim 20 in which said slanted heat exchange surface and said slanted cooling surface are substantially parallel and are slanted at an acute angle of about 30° to about 35° relative to the horizontal.

26. The apparatus of claim 20 in which said cooling surface is on an upper side of said cooling member and supports said bag in said freezing chamber, and said heat exchange assembly transfers heat from a lower side of said cooling member.

27. The apparatus of claim 20 in which said cooling means further includes thermoelectric modules for transferring heat from said cooling member to said heat exchange assembly.

* * * * *